US006516518B1

(12) United States Patent
Garraway et al.

(10) Patent No.: US 6,516,518 B1
(45) **Date of Patent: *Feb. 11, 2003**

(54) RAZOR BLADE UNIT

(75) Inventors: Richard Garraway, Guildford Gui (GB); Bernard Gilder, Twyford Berkshire (GB)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/113,460

(22) Filed: Jul. 10, 1998

Related U.S. Application Data

(63) Continuation of application No. PCT/US97/00407, filed on Jan. 8, 1997.

(30) Foreign Application Priority Data

Jan. 12, 1996 (GB) ..... 9600620

(51) Int. Cl.[7] ..... B26B 19/42
(52) U.S. Cl. ..... 30/34.2; 30/81
(58) Field of Search ..... 30/34.2, 81, 82

(56) References Cited

U.S. PATENT DOCUMENTS

| | | | | |
|---|---|---|---|---|
| 3,722,090 A | * | 3/1973 | Dawidowicz | 30/34.2 |
| 3,797,110 A | * | 3/1974 | Michelson | 30/82 |
| 4,189,832 A | | 2/1980 | Harper et al. | 30/34.2 |
| 4,247,982 A | | 2/1981 | Booth et al. | 30/41 |
| 4,741,103 A | | 5/1988 | Hultman | 30/34.2 |
| 4,998,347 A | * | 3/1991 | Schachter | |
| 5,092,042 A | | 3/1992 | Miller et al. | 30/77 |
| 5,191,712 A | * | 3/1993 | Crook et al. | 30/34.2 |
| 5,249,361 A | | 10/1993 | Apprille, Jr. et al. | 30/77 |
| 5,416,973 A | | 5/1995 | Brown et al. | 30/34.2 |
| 5,689,883 A | | 11/1997 | Ortiz et al. | 30/34.2 |
| 5,711,076 A | * | 1/1998 | Yin et al. | 30/34.2 X |
| 5,903,979 A | | 5/1999 | Oldroyd | 30/41 |
| 5,953,819 A | * | 9/1999 | Simms et al. | |
| 6,131,287 A | * | 10/2000 | Prochaska et al. | |
| 6,167,625 B1 | * | 1/2001 | King et al. | |

FOREIGN PATENT DOCUMENTS

| | | |
|---|---|---|
| EP | 0397638 | 11/1990 |
| SU | 673 449 | 7/1979 |
| WO | 96/35558 | 11/1996 |

OTHER PUBLICATIONS

Reference is made to co–pending U.S. Ser. No. 09/141,436, as discussed in the I.D.S.

* cited by examiner

*Primary Examiner*—Kenneth E. Peterson
(74) *Attorney, Agent, or Firm*—Fish & Richardson P.C.

(57) ABSTRACT

In a safety razor blade unit a skin engaging member has a surface for contacting the skin during shaving defined by spaced hollow projections (3) which extend upwardly from a base (2) and are open at their upper ends. The projections are made of a resiliently flexible material and are preferably arranged in rows along the base. The projections are preferably tubular but can taper in either direction, internally and/or externally.

17 Claims, 6 Drawing Sheets

RAZOR BLADE UNIT

This is a continuation of copending application International Application PCT/US97/00407 filed on Jan. 8, 1997 and which designated the U.S., claims the benefit thereof and incorporates the same by reference.

This invention relates to shaving devices and concerns a safety razor blade unit having at least one blade with a cutting edge which is moved across the surface of the skin being shaved by means of a handle to which the blade unit is attached. The blade unit may be mounted detachably on the handle to enable the blade unit to be replaced by a fresh blade unit when the blade sharpness has diminished to an unsatisfactory level, or it may be attached permanently to the handle with the intention that the entire razor be discarded when the blade or blades have become dulled. Razor blade units generally include a guard which defines a surface for contacting the skin in front of the blade(s) and a cap for contacting the skin behind the blade(s), the cap and guard serving important roles in establishing the so-called "shaving geometry", i.e. the parameters which determine the blade orientation and position relative to the skin during shaving. The present invention is especially concerned with the guard and/or cap of a razor blade unit.

It is known to provide a skin engaging guard or cap with surface configurations intended to produce pleasant tactile sensations during shaving, for example as described in U.S. Pat. No. 5,191,712.

The present invention aims to provide an improved surface structure on a cap or guard and in accordance with this object the invention resides in a safety razor blade unit having at least one elongate blade, and a skin engaging member defining a surface for contact with the skin during shaving, said surface being defined by spaced hollow projections extending upwardly from a base and open at their upper ends, the projections being formed of a resiliently flexible material whereby the upper ends of the projections can deflect locally under forces encountered during shaving.

Conveniently the projections can take the form of tubes which may be arranged in one or more rows extending along the base generally parallel to the razor blade edge(s), with at least 10 tubes per row. Suitably the projections have a height in the range of 0.38 mm to 1.5 mm preferably about 0.75 mm, an outer diameter from 0.40 mm to 3.00 mm, preferably about 0.60 mm, and with the wall thickness at the base to height ratio being between 1:1 and 1:15, preferably around 1:7.5. An appropriate spacing between adjacent projections, at least in the direction parallel to the blade edge(s), is in the range from 0.10 mm to a distance equal to the maximum dimension of the projection measured in said direction, the spacing in a currently preferred embodiment being 0.20 mm. If desired adjacent projections can be interconnected, such as by membranes moulded integrally with the projections.

The projections may be of constant internal and external diameter, but they can also taper in either direction along their length both inside and/or outside. A suitable wall thickness for the hollow projections has been found to be around 0.10 mm, at least at their upper edges. It is not essential for the projections to be completely annular in cross-section and they can have one or more longitudinal slots extending over their full height or only part of their height.

In the preferred embodiments described in more detail below, tubes of circular in cross-section are provided but this is not essential and other cross-sectional shapes are possible, such as elliptical, square or D-shaped.

The upper end faces of the projections can be substantially flat and coplanar. Alternatively the upper end faces may be inclined forwardly and downwardly toward the base. Also the upper edges of the projections may be rounded off, at least at the fronts of the projections.

With a razor blade unit according to the invention the projections forming the skin contacting surface of the skin engaging member, because they are hollow and open at the top, can be more responsive to local forces during shaving, e.g. due to a hair being encountered, than solid projections and as a consequence there may be less tendency for hairs to be deflected laterally by the projections. Furthermore, the hollow projections form pockets in which moisture or a shaving preparation, such as shaving soap or the like, applied to the skin to facilitate the shaving operation, can collect in small amounts. A shaving preparation generally serves to lubricate the skin. Any preparation collected in the pockets may assist in lubricating the skin, e.g. at the end of a shave when most of the preparation applied will have been removed, or perhaps at the beginning of a shave if the skin has not been well prepared. The skin engaging member could even be supplied with the pockets containing shaving enhancement product, or possibly communicating with a reservoir of such a product to be dispensed through the pockets, in essentially the same manner as described in relation to the pocketed skin engaging members disclosed in our International Patent Application No. PCT/US95/08634 (WO96/02369). With the present invention delivery of product from the pockets may be enhanced by a pumping action due to the projections flexing as the skin contacting member moves across the surface of the skin.

Some embodiments of the invention are described in more detail below with reference to the accompanying drawings, in which.

The skin engaging member 1 illustrated in FIGS. 1–6 is intended to form either a cap, or more probably a guard surface in a safety razor blade unit having one or more elongate blades. The member 1 is elongated and will be mounted on a frame of the blade unit to extend in parallel with the blades. The member 1 is moulded in one piece of an elastomeric material, e.g. rubber or a thermoplastic elastomer such as that sold under the Trade Mark KRATON. It includes a rectangular base 2 from which extend upwardly, cylindrical open-topped hollow projections or tubes 3. The tubes are arranged in four longitudinal rows in which the tubes 3 are equally spaced at a distance not greater than the outer diameter of the tubes, and the tubes of alternate rows are longitudinally staggered by a distance which is half the centre-to-centre pitch P of adjacent tubes in the same row. As a consequence, tubes of adjacent rows overlap in the longitudinal direction, and as shown they also overlap in the front to rear direction. The dimensions are as follows:

Base length—l: 30.00 mm

Base width—w: 2.5 mm

Tube height—h: 0.75 mm

Tube outer diameter—$d_1$: 0.60 mm

Tube inner diameter—$d_2$: 0.40 mm

Tube wall thickness—t: 0.1 mm

Tube pitch (in each row)—p: 1.23 mm

Number of tubes per row: 24

Total number of tubes: 96

Figure 1:
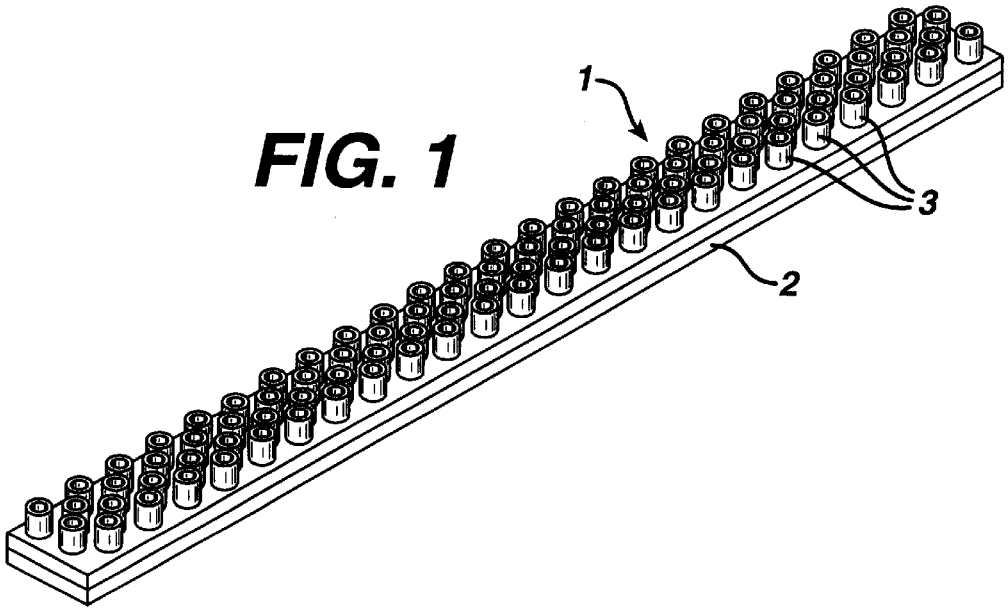
FIG. 1 shows in perspective a skin contacting member for a blade unit according to the invention.
Figure 3:
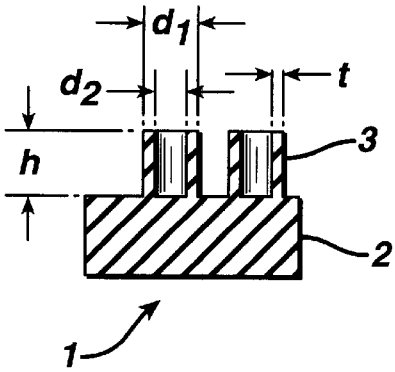
FIG. 3 is a cross-section taken along the line A—A of FIG. 2.
Figure 5:
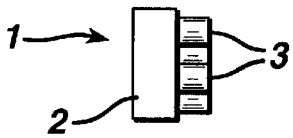
FIGS. 4 and 5 are front and end elevational views of the skin engaging member.
Figure 2:
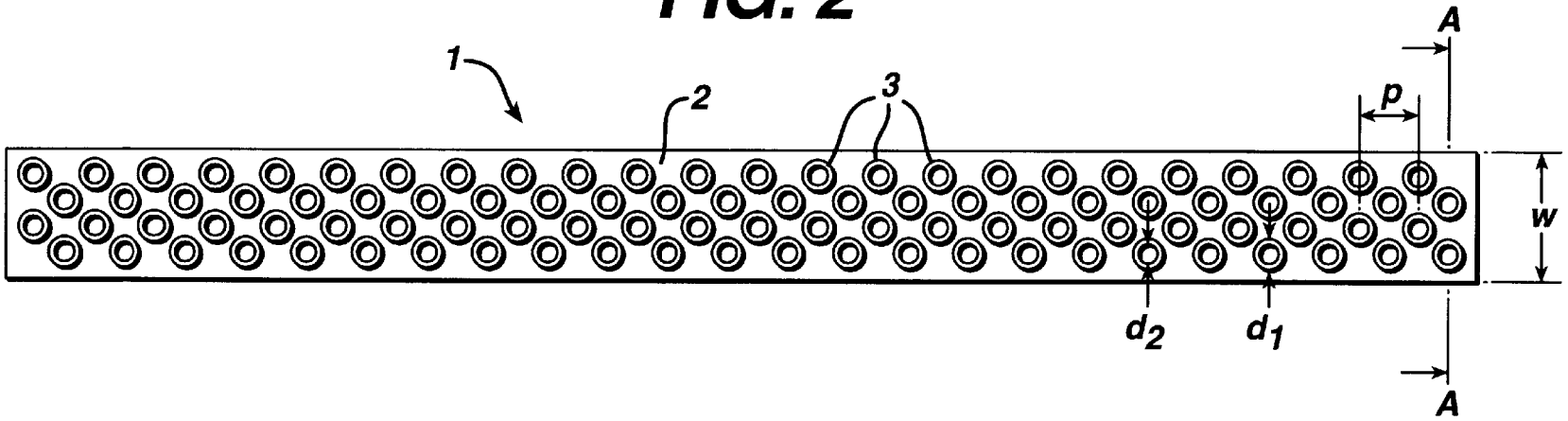
FIG. 2 is a plan of the skin engaging member.
Figure 4:
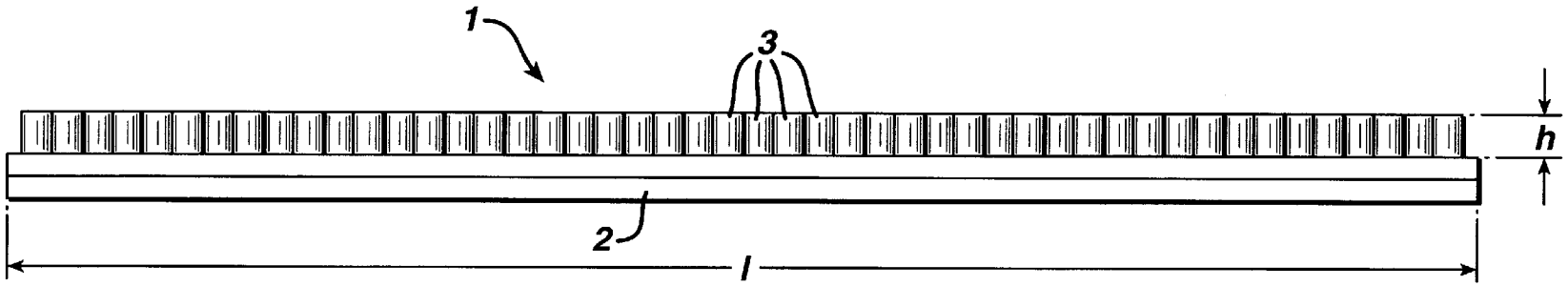
Figure 6:
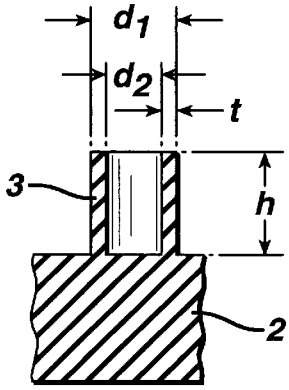
FIGS. 6 to 17 are enlarged cross-sectional views of alternative forms of hollow projection.
Figure 7:
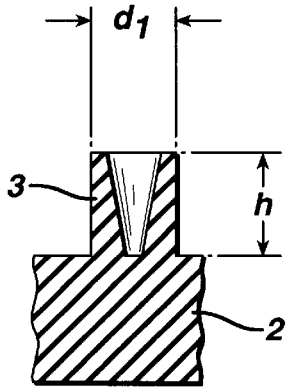
Figure 8:
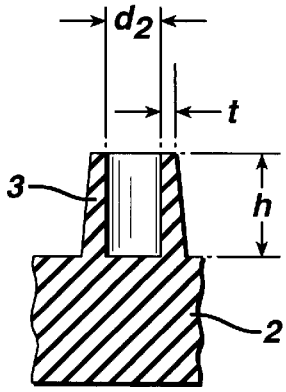
Figure 9:
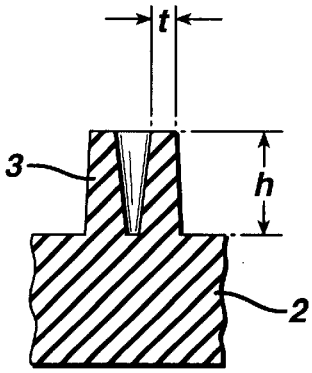
Figure 10:
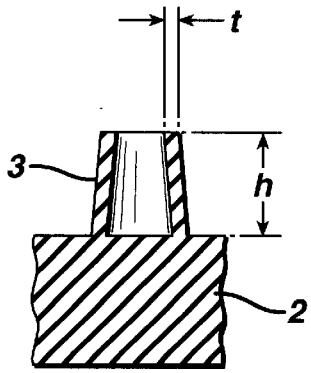
Figure 11:
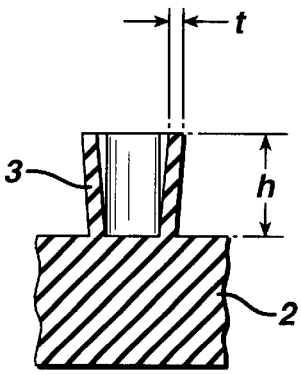
Figure 12:
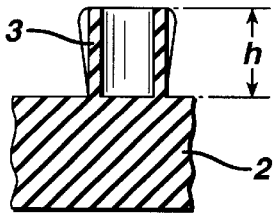
Figure 13:
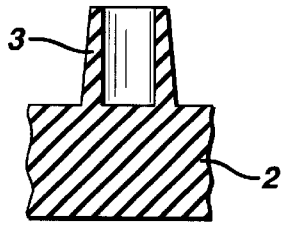
Figure 14:
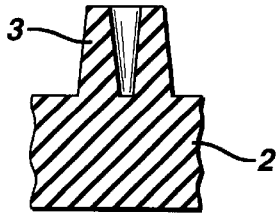
Figure 15:
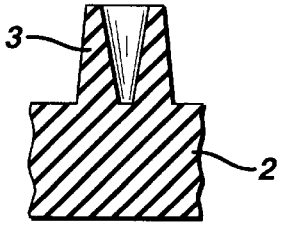
Figure 16:
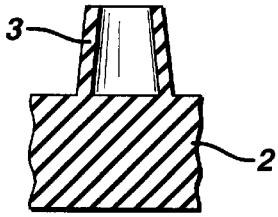
Figure 17:
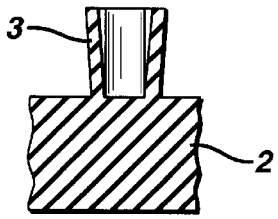

The tubes 3 have a constant circular cylindrical cross section as clearly illustrated in FIG. 6. However this particular tube shape is not essential and FIGS. 7 to 11 illustrate alternative shapes as follows:

In FIG. 7 the hollow interior tapers towards the base from a maximum inner diameter of 0.4 mm to a minimum inner diameter of 0.4 mm;

In FIG. 8 the exterior is frusto-conical and tapers from a diameter of 0.7 mm at the base to 0.6 mm at the top, the inner diameter being constant at 0.4 mm;

In FIG. 9 the exterior is frusto-conical as in FIG. 8, and the hollow interior tapers towards the base and has a maximum diameter at the top of 0.25 mm so that a greater wall thickness is obtained;

In FIG. 10 the exterior is frusto-conical as in FIGS. 8 and 9, and the interior has a corresponding frusto-conical shape so that the wall thickness remains constant over the full height and the inner diameter increases from 0.4 mm at the top to 0.5 mm at the base;

In FIG. 11 an inverted frusto-conical shape with a constant wall thickness is shown, the maximum inner diameter at the top being 0.5 mm and the maximum inner diameter at the base being 0.4 mm;

In FIG. 12 another inverted frustoconical shape is shown, the inner diameter being constant at 0.3 mm whereas the outer diameter increase from 0.5 mm at the base and the top peripheral edge gf the tubular projection is rounded off at a radius of 0.1 mm;

In FIGS. 13 and 14 the tubular projections are as shown in FIGS. 8 and 9 respectively, except that in each case the outside diameter at the base is 0.75 mm;

In FIG. 15 is shown a tubular projection having the same external form of the projection of FIG. 14, but with a larger inner diameter at the open top end where the wall thickness is minimum and about 0.1 mm;

In FIG. 16 the illustrated tubular projection is the same as that of FIG. 10 other than that the outer diameter at the base is 0.75 mm, and the inner diameter at the base is 0.55 mm, the wall thickness being uniform at 0.1 mm; and In FIG. 17 the tubular projection is similar in shape to that of FIG. 11, but the diameters are reduced, the outer diameter at the base being 0.5 mm, and the inner diameter increasing from 0.3 mm at the base to 0.4 mm at the open end, the wall thickness being constant at 0.1 mm.

Figure 18:
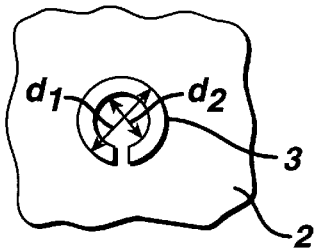
FIG. 18 is a plan view of a projection of a modified embodiment.
Figure 19:
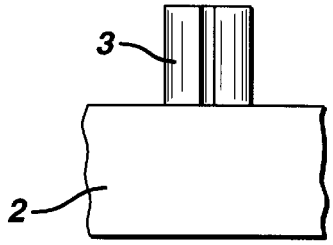
FIG. 19 is a front elevation of the projection shown in FIG. 18.

In the embodiments described above the projections have completely annular cross-sections, but in the modified embodiment of FIGS. 18 and 19, the tubular projection has a longitudinal slot extending the full height of the tube at the front of the tube. Apart from the slot, which has a width of 0.1 mm, the tubular projection is of the same shape and size as in the embodiment of FIGS. 1—6. The slot could be provided at other positions, and additional slots could also be provided.

Figure 20:
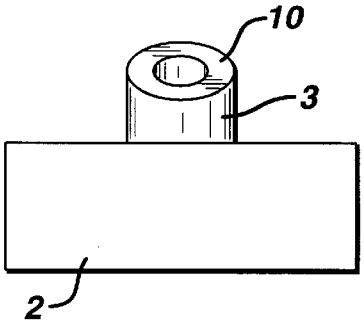
FIG. 20 is a front elevation showing a projection with an inclined top face.
Figure 21:
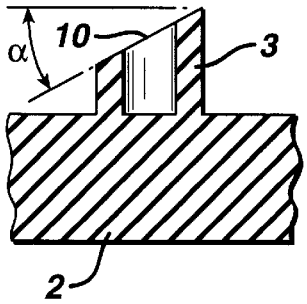
FIG. 21 is a cross-section through the hollow projection of FIG. 20.
Figure 22:
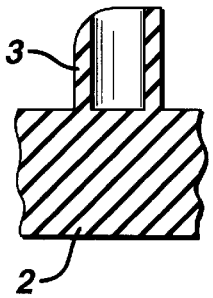
FIG. 22 is a cross-sectional view showing a projection with a top edge which is rounded off at the front.

In all of the embodiments described above the tubular projections have a height of 0.75 m and are essentially flat-topped in as much that the height is the same around the projection periphery. This is not crucial and it may be beneficial for the upper edge of the projection to be relieved, in particular in the forward facing direction. FIGS. 20 and 21 illustrate an example of a tubular projection 3 basically the same as the projections of FIGS. 1 to 6, but having a forwardly and downwardly inclined top face 10, the downward inclination being at an angle $\alpha$ of about 30°. FIG. 21 shows an alternative modification according to which the front edge 11 at the upper end of the tubular projection 3 is rounded off at a radius of 0.3 mm. While illustrated in relation to tubular projections as in FIGS. 1 to 6, the inclined top face 10 and rounded edge 11 modifications of FIGS. 20 to 22 can be applied to any of the embodiments of FIGS. 7 to 19, and to the modified embodiments described below.

Figure 23:
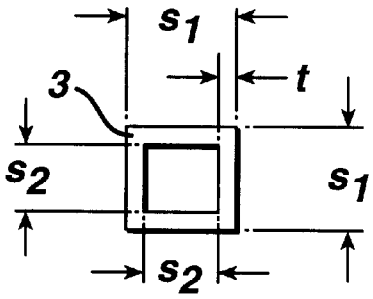
FIGS. 23 to 26 show in plan respective alternative shapes for the projections.
Figure 24:
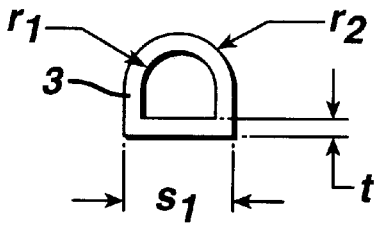
Figure 25:
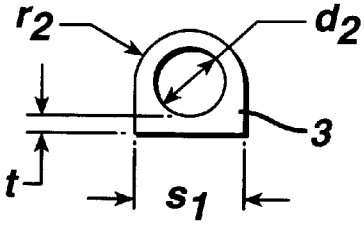
Figure 26:
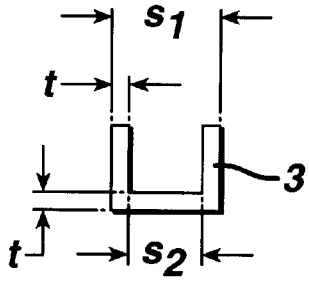

All of the embodiments so far described have tubular projections of substantial circular cross-section. However, other cross-sections are also satisfactory, and some examples of other acceptable cross-sections are illustrated in FIGS. 23 to 26. The projection 3 in FIG. 23 is square in cross section, the wall thickness t being 0.1 mm, the exterior having a side length $S_1$ of 0.6 mm and the interior having a side length $S_2$ of 0.4 mm. The tubular projection of FIG. 24 is substantially D-shaped in cross-section, being essentially the square section of FIG. 23 with one side replaced by a semi-circular wall with an inside radius $r_1$ of 0.2 mm and an outside radius $r_2$ of 0.3 mm. The semi-circular wall could be arranged to face either forwardly or rearwardly. The cross-section of the tubular projection shown in FIG. 25 has the same external profile as that of FIG. 24, but the internal profile is circular with a diameter of $d_2$ of 0.4 mm. Finally, FIG. 26 shows a projection having a cross-section shaped as an open-sided square and is the same as the projection of FIG. 23 but with the rear wall omitted. It will be appreciated that projections with the cross-sections of FIGS. 23 to 26 could be arranged to taper internally and/or externally as in the various projections of FIGS. 7 to 17. Of course other cross-sectional shapes are also possible such as triangular, elliptical or oral.

While in any particular embodiment all the projections can conveniently be of the same shape and size, this is not essential and projections of different form could be combined in the same embodiment.

The material of the skin engaging member will have a flexibility appropriate for the particular shape and size of projections provided, but a hardness of less than 90 shore A will normally be appropriate.

What is claimed is:

1. A safety razor blade unit having at least one elongate blade, and a skin engaging member defining a surface for contact with the skin during shaving, said surface being defined by spaced hollow projections extending upwardly from a base and open at their upper ends, each said spaced, hollow projection having a continuous wall that is spaced from walls of adjacent projections and extends all of the way around an internal hollow region from said base to said upper end, the projections being formed of resiliently flexible material whereby the upper ends of the projections can be deflected locally under forces encountered during shaving, wherein the height of the projections above the base is greater than or equal to 0.38 mm.

2. A safety razor blade unit according to claim 1, wherein the projections are arranged on the base in a geometric pattern.

3. A safety razor blade unit according to claim 1, wherein the projections are arranged in at least one row extending along the base in a direction generally parallel to the blade edge(s).

4. A safety razor according to claim 3, wherein there are at least three parallel rows of projections, and the projections in one row are longitudinally offset with respect to the projections of an adjacent row.

5. A safety razor blade unit according to claim 1, wherein the upper end faces of the projections are inclined downwardly and forwardly towards the base.

6. A safety razor blade unit according to claim 1, wherein the external edges at the upper ends of the projections are rounded off at the fronts of the projections.

7. A safety razor blade unit according to claim 1, wherein the hollow interiors of the projections taper along the projections.

8. A safety razor blade unit according to claim 7, wherein the hollow interiors taper towards the base.

9. A safety razor blade unit according to claim 1, wherein the projections have a wall thickness at the base, to height ratio in the range of 1:1 to 1:15, preferably about 1:7.5.

10. A safety razor blade unit according to claim 1, wherein the projections are substantially circular in cross-section.

11. A safety razor blade unit according to claim 1, wherein the projections have a cross-sectional shape selected from square or D shape.

12. A safety razor blade unit having at least one elongate blade, and a skin engaging member defining a surface for contact with the skin during shaving, said surface being defined by spaced hollow projections extending upwardly from a base and open at their upper ends, each said spaced, hollow projection having a continuous wall that is spaced from walls of adjacent projections and extends all of the way around an internal hollow region from said base to said upper end, the projections being formed of resiliently flexible material whereby the upper ends of the projections can be deflected locally under forces encountered during shaving, wherein the projections are arranged in at least one row extending along the base in a direction generally parallel to the blade edge(s), wherein there are at least three parallel rows of projections, and the projections in one row are longitudinally offset with respect to the projections of an adjacent row, wherein the projections have an external dimension measured longitudinally of a row which is greater than the spacing between adjacent projections in the same row.

13. A safety razor blade unit having at least one elongate blade, and a skin engaging member defining a surface for contact with the skin during shaving, said surface being defined by spaced hollow projections extending upwardly from a base and open at their upper ends, each said spaced, hollow projection having a continuous wall that is spaced from walls of adjacent projections and extends all of the way around an internal hollow region from said base to said upper end, the projections being formed of resiliently flexible material whereby the upper ends of the projections can be deflected locally under forces encountered during shaving, wherein the projections have the form of tubes with an outside diameter in the range of 0.40 to 3.00 mm.

14. A safety razor blade unit according to claim 13, wherein the outer diameter is in the range of 0.6 mm to 0.8 mm.

15. A safety razor blade unit having at least one elongate blade, and a skin engaging member defining a surface for contact with the skin during shaving, said surface being defined by spaced hollow projections extending upwardly from a base and open at their upper ends, each said spaced, hollow projection having a continuous wall that is spaced from walls of adjacent projections and extends all of the way around an internal hollow region from said base to said upper end, the projections being formed of resiliently flexible material whereby the upper ends of the projections can be deflected locally under forces encountered during shaving, wherein the projections have walls of substantially constant thickness along the projections.

16. A safety razor blade unit having at least one elongate blade, and a skin engaging member defining a surface for contact with the skin during shaving, said surface being defined by spaced hollow projections extending upwardly from a base and open at their upper ends, each said spaced, hollow projection having a continuous wall that is spaced from walls of adjacent projections and extends all of the way around an internal hollow region from said base to said upper end, the projections being formed of resiliently flexible material whereby the upper ends of the projections can be deflected locally under forces encountered during shaving, wherein the height of the projections above the base is in the range of 0.38 mm to 1.5 mm.

17. A safety razor blade unit according to claim 16, wherein the height of the projections is about 0.75 mm.

* * * * *